United States Patent [19]

Söderberg

[11] Patent Number: 5,048,516

[45] Date of Patent: Sep. 17, 1991

[54] RESPIRATORY MASK

[76] Inventor: Stig Söderberg, St. Spelbo, S-680 96 Lesjöfors, Sweden

[21] Appl. No.: 460,182

[22] PCT Filed: Jul. 14, 1988

[86] PCT No.: PCT/SE88/00380

§ 371 Date: Feb. 13, 1990

§ 102(e) Date: Feb. 13, 1990

[87] PCT Pub. No.: WO89/00874

PCT Pub. Date: Feb. 9, 1989

[30] Foreign Application Priority Data

Jul. 28, 1987 [SE] Sweden ..... 8702983

[51] Int. Cl.[5] ..... A62B 18/02

[52] U.S. Cl. ..... 128/205.25; 128/200.27

[58] Field of Search ..... 128/200.27, 200.28, 128/201.25, 201.29, 205.25, 206.28

[56] References Cited

U.S. PATENT DOCUMENTS

| | | | |
|---|---|---|---|
| 3,295,521 | 1/1967 | Balch | 128/206.28 |
| 3,529,594 | 9/1970 | Charnely | 128/201.29 |
| 3,683,907 | 8/1972 | Cotabish | 128/200.28 |
| 3,990,112 | 11/1976 | Ciffolillo | 128/201.29 |
| 4,019,508 | 4/1977 | Der Estephanian et al. | 128/201.29 |
| 4,055,173 | 10/1977 | Knab | 128/201.29 |
| 4,207,888 | 6/1980 | Ghormley | 128/205.25 |
| 4,216,769 | 8/1980 | Grimes | 128/205.25 |
| 4,593,688 | 6/1986 | Payton | 128/200.28 |

FOREIGN PATENT DOCUMENTS

| | | | |
|---|---|---|---|
| 154988 | 6/1938 | Austria | 128/205.25 |
| 595970 | 4/1934 | Fed. Rep. of Germany | 128/205.25 |
| 34762 | 4/1952 | Poland | 128/205.25 |
| 127124 | 5/1919 | United Kingdom | 128/205.25 |
| 621010 | 4/1949 | United Kingdom | 128/205.25 |

*Primary Examiner*—Aaron J. Lewis

*Attorney, Agent, or Firm*—Finnegan, Henderson, Farabow, Garrett & Dunner

[57] ABSTRACT

A respiratory mask supplies air to a user from an external air source. The mask includes a face shield which sealingly engages the user's cheeks at the sides. The top of the face shield is open. The bottom is fixed to a pliable air hose having a U-shape, which sealingly engages the user's face just below the lower lip. Nozzles in the pliable air hose direct air upward into the mask. Another air hose connected to the U-shaped air hose extends away from the mask and connects to the external air source.

12 Claims, 1 Drawing Sheet

RESPIRATORY MASK

The present invention refers to a respiratory mask, i.e. a device which has for its purpose to prevent inhalation of air which by some reason is estimated to be unsuitable to inhale for instance by containing poisonous gases such as welding fumes, exhaust gas from internal combustion engines and the like but also by containing pollen or other stuffs which can provide undesired reactions in persons with allergies.

Most of the respiratory masks which have been suggested in the past have been specially designed for one single purpose such as for protecting welders from welding fumes but above all they have proven to cause such discomfort and have such other negative properties in use that they have only been used in exceptional circumstances.

From the view of functions respiratory masks may be divided into two main groups. The first group are passive ones, which substantially comprise a hood which sealingly surrounds at least the respiratory organs and comprise a filter through which respiration takes place. The second group are active ones, by which a filtered air stream generated by a fan is directed towards the face of the user. Respiratory masks of the first cathegory may in most cases only be used for short times due to the big breathing resistance caused by the filter.

Respiratory masks of the second cathegory are usually so designed that they need stationary devices for generating the necessary pressurized air and the air streams cause irritation in the eyes of the user.

The majority of the resporatory masks are further such designed that they give the user a sense of being closed in and prevent in most cases speaking communication between the user and his neighbourhood.

The object of the invention thus has primarily been to provide a more universal respiratory mask which is not encumbered with the above-mentioned deficiencies and which further may be produced at a reasonably low cost and with such dimensions and such weight that it without difficulty or discomfort may be used during long periods of time and thereby give the user an effective protection against the harmful or disagreeable materials contained in the air at the same time as it eliminates the feeling of being closed in and offers a possibility to speek freely to persons in his enviroment. In order to accomplish these and further objects the invention has the characteristics of the patent claims.

Figure 1:
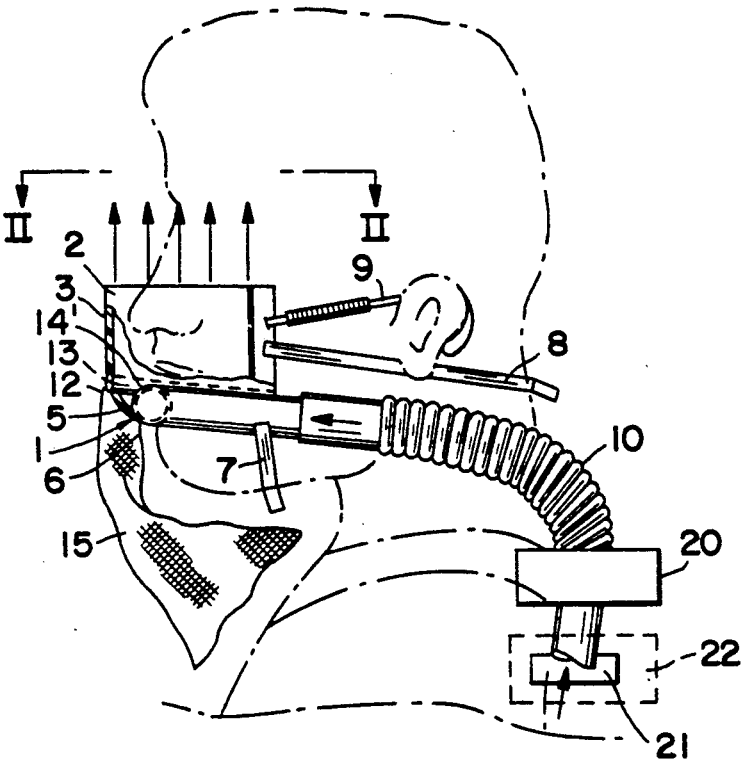
Figure 2:
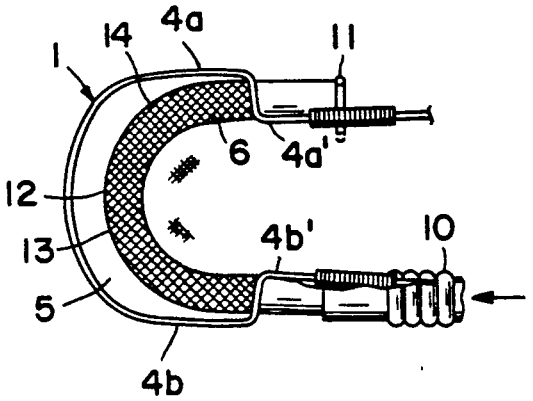

In the accompanying drawing an exemplary embodiment of the invention is shown and FIG. 1 is a side view partly in cross-section of a respiratory mask according to the invention and FIG. 2 is a top cross-sectional view taken along line II—II in FIG. 1.

The respiratory mask illustrated in the drawing which has been given the general designation 1 comprises a container or cover 2 having the upper end thereof open and having a substantially vertical front wall 3 which as appears from FIG. 1 in the position of use is situated in front of a vertical plane through the foremost part of the users nose. The front wall 3 continues in side walls 4*a*, 4*b* which are shaped in such a way that they contact the cheeks at least by the inner portions 4*a*', 4*b*' by means of internal sealings. At the lower end thereof the front wall 3 continues via a rounded transition in a bottom wall 5, which in the illustrated embodiment is inclined and ends in a combined sealing portion and pressure chamber, which in the illustrated embodiment has the shape of a hose made from a soft and flexible material such as softened plastic rubber or the like and which is intended to be applied against that portion of the users chin which is situated just below the under lip. A peripheral surface 16 of the hose 6 is further shaped in accordance with the user's face such that it seals against the portion just below the under lip as well as against the corresponding portions of the cheeks.

In order to keep the respiratory mask in place it may according to FIG. 1 have a chin-strap 7 a neck-strap 8 and a bowed portion 9 for each ear. The straps 7 and 8 may in a manner known per se be adjustable as to their length or resilient and the bows are in the illustrated embodiment axially resilient. The hose 6 or a second hose is operatively connected at one end to corrugated and thereby particularly resilient hose 10 or first hose which leads to a pressurized air source and the opposite end of second hose 6 is completely or partly closed by means of a plug 11 (see FIG. 2).

The hose 6 has in the part thereof which is located inside the cover 2 a plurality of holes 12,13 serving as nozzles, from which a first series 12 are directed towards the front wall 3 and a second series 13 are directed substantially upwardly towards the nose of the user. The hose 10 is attached to pressurized air source 21 and preferably has a filter (shown generally in FIG. 1 as 20). The air jet streams coming from the hose 6 which acts as an air channel and which streams by means of the nozzle holes 12 are directed towards the front wall 3 hit the front wall and are deflected from this one such that they form substantially upwardly directed air streams and owing to the fact that the cover is closed downwardly and at the sides there is generated an upwardly directed air seal in front of the nostrils. The air seal locks out the ambient air and unites with the air jet streams which via the openings 13 are directed towards the nostrils.

Since the cover 2 only is open upwardly, intake of polluted ambient air by ejector function is prevented and the required amount of air is minimized and the speed of the air may be held low. The dimension of the nozzle openings and the direction thereof may of course be varied such that the stream conditions most suitable for the specific use may be obtained. Owing to the moderate required amount of air the supply of air can be obtained by means of a small battery powered fan (shown generally in FIG. 1 as 21) which makes it possible for the user to carry it for instance in a bag (shown generally in FIG. 1 as 22) or by means of a harness. Since the cover has an open upper end the respirator mask will not seem enclosing and the user may communicate with his surroundings without difficulty. In the illustrated embodiment the upper end portion of the cover 2 is in the same level as the nostrils of the user but the cover may of course be higher and in certain instances also lower.

The respiratory mask now described may successfully be used by persons with allergies, and for persons concerned with appearance there can be secured to the cover a covering veil 15 to make the product as discreet as possible.

In order to achieve an even distribution of the air streams a finely meshed net 14 or a perforated plastics sheet may be secured a little bit above the nozzle mouths and as appears from FIG. 1 such a net can reach the wall 3 with one part 14' thereof.

I claim:

1. A respiratory mask for supplying air from an external air source to a user comprising:

a face shield covering a portion of the user's face, including a substantially vertical front portion covering the user's nose and mouth, first and second side portions having side edges sealingly engaging the user's cheeks, an upper portion having an upper edge, and a bottom portion having a bottom edge;

means for supplying the air to said face shield, including a first air hose extending from the external air source and penetrating one portion of said face shield, and a second air hose connected to said first air hose and having a peripheral surface curved in a substantial U-shape sealingly engaging the user's face proximate and directly below the user's lower lip, and a plurality of nozzle openings in said surface for distributing the air within said face shield, said bottom portion of said face shield being fixed to said peripheral surface of the second air hose to prevent escape of the air from said bottom portion of said face shield.

2. The respiratory mask of claim 1, wherein said plurality of nozzle openings are covered by a finely meshed net to evenly distribute the air within said face shield.

3. The respiratory mask of claim 1, further including adjusting means for adjusting the position of said second air hose to ensure sealing engagement with the user's face proximate and below the lower lip.

4. The respiratory mask of claim 1, wherein said second air hose is connected at one end to said first air hose and is closed at the other end away from the first air hose.

5. The respiratory mask of claim 1, wherein said nozzle openings are upwardly directed to distribute the air toward the user's nose.

6. The respiratory mask of claim 1, wherein said nozzle openings are disposed to distribute the air toward the front portion of said face shield to be deflected within the face shield.

7. The respiratory mask of claim 1, further including filter means for filtering the air.

8. The respiratory mask of claim 3, wherein said adjusting means include bowed portions fitting around the ears of the user.

9. The respiratory mask of claim 1, further including a portable fan attachable to the first hose.

10. The respiratory mask of claim 8, further including a container for carrying the portable fan.

11. The respiratory mask of claim 1, further including a veil attachable to the front portion of said face shield.

12. The respiratory mask of claim 1, wherein said upper edge of said face shield is spaced away from the user's face.

* * * * *